US010707028B2

(12) United States Patent
Ji et al.

(10) Patent No.: US 10,707,028 B2
(45) Date of Patent: Jul. 7, 2020

(54) AUTOMATIC TRANSFER SWITCH AND DRIVE SUBSYSTEM

(71) Applicant: Cummins Power Generation IP Inc., Minneapolis, MN (US)

(72) Inventors: Xuefeng Ji, Shanghai (CN); Tongxian Hu, Shanghai (CN); Dongyan Chu, Shanghai (CN)

(73) Assignee: Cummins Power Generation IP Inc., Minneapolis, MN (US)

( * ) Notice: Subject to any disclaimer, the term of this patent is extended or adjusted under 35 U.S.C. 154(b) by 29 days.

(21) Appl. No.: 15/739,603

(22) PCT Filed: Jun. 26, 2015

(86) PCT No.: PCT/CN2015/082436

§ 371 (c)(1),
(2) Date: Dec. 22, 2017

(87) PCT Pub. No.: WO2016/206068

PCT Pub. Date: Dec. 29, 2016

(65) Prior Publication Data

US 2018/0190441 A1 Jul. 5, 2018

(51) Int. Cl.

| | |
|---|---|
| ***H01H 9/00*** | (2006.01) |
| ***H01H 3/22*** | (2006.01) |
| ***H01H 3/28*** | (2006.01) |

(52) U.S. Cl.

CPC ..... *H01H 3/22* (2013.01); *H01H 3/28* (2013.01); *H01H 2300/018* (2013.01)

(58) Field of Classification Search

CPC ..... H01H 50/18; H01H 50/60; H01H 50/644; H01H 50/54; H01H 47/22; H01H 33/28;
(Continued)

(56) References Cited

U.S. PATENT DOCUMENTS 3,593,816 A * 7/1971 Kazaoka ..... E05B 77/48 180/281
RE28,142 E * 9/1974 Kazaoka ..... E05B 77/48 180/289

(Continued)

FOREIGN PATENT DOCUMENTS

| | | |
|---|---|---|
| CN | 101145468 | 3/2008 |
| CN | 101350259 | 1/2009 |

(Continued)

OTHER PUBLICATIONS

Translation of the International Search Report for International Application No. PCT/CN2015/082436, dated Apr. 1, 2016, 2 pages.

*Primary Examiner* — Shawki S Ismail
*Assistant Examiner* — Lisa N Homza
(74) *Attorney, Agent, or Firm* — Foley & Lardner LLP

(57) ABSTRACT

A transmission subsystem has an automatic transfer switch (100) which includes at least a pair of movable contact members (28, 30). The pair of movable contact members includes a first movable contact member (28) at a first location and a second movable contact member (30) at a second location. The automatic transfer switch further includes a fixed member (29), a controller (68) configured to select one of the first and second movable contact members, and a permanent magnetic actuator (65). The permanent magnetic actuator includes an actuator body, a first driving rod (60), and a second driving rod (62). The permanent magnet actuator is configured to move the first driving rod in a first direction independently of movement of the second driving rod. The first driving rod is configured to move the first movable contact member, and the second driving rod is configured to move the second movable contact member.

22 Claims, 4 Drawing Sheets

(58) Field of Classification Search
CPC ..... H01H 33/42; H01H 33/50; H01H 3/22; H01H 2300/018
USPC ..... 335/205
See application file for complete search history.

(56) References Cited

U.S. PATENT DOCUMENTS 3,936,782 A * 2/1976 Moakler ..... H01H 3/28 335/161
4,021,678 A * 5/1977 Moakler ..... H01H 71/002 307/64
4,423,336 A * 12/1983 Iverson ..... H01H 3/26 307/64
4,590,387 A * 5/1986 Yoshida ..... H01H 50/644 200/50.33
4,804,933 A * 2/1989 Becker ..... H01H 3/52 218/154
5,070,252 A * 12/1991 Castenschiold ..... H01H 71/002 307/113
6,815,624 B2 * 11/2004 Schultz ..... H01H 9/0066 200/50.33
7,898,372 B2 * 3/2011 Melchionne, Jr. ..... H01H 3/28 200/1 R
8,138,861 B2 * 3/2012 Krieger ..... H01H 1/50 335/168
8,471,659 B1 * 6/2013 Flegel ..... H01H 9/26 307/126
2002/0057146 A1 * 5/2002 McMillan ..... H01H 89/06 335/35
2002/0130023 A1 * 9/2002 Milman ..... H01H 9/0066 200/293
2003/0090348 A1 * 5/2003 Simms ..... H01H 89/06 335/6
2010/0038966 A1 * 2/2010 Espeut, Jr. ..... H01H 9/26 307/68
2010/0288610 A1 * 11/2010 Krieger ..... H01H 1/50 200/327
2014/0232491 A1 * 8/2014 Moroz ..... H01H 9/0072 335/128
2014/0240064 A1 * 8/2014 Plude ..... H01B 5/12 335/6
2015/0055268 A1 * 2/2015 Chapel ..... H01H 47/02 361/160
2016/0351351 A1 * 12/2016 Ji ..... H01H 3/28
2017/0103865 A1 * 4/2017 Ji ..... H01H 33/28
2017/0117747 A1 * 4/2017 Zhou ..... H01H 3/28
2019/0165601 A1 * 5/2019 Supriya ..... H02J 9/06

FOREIGN PATENT DOCUMENTS

CN 102034619 4/2011
CN 103077837 5/2013

* cited by examiner

AUTOMATIC TRANSFER SWITCH AND DRIVE SUBSYSTEM

FIELD

The present application relates to a transmission subsystem with an automatic transfer switch operating mechanism.

BACKGROUND

Automatic transfer switches (ATSs) for consumer applications may be used, for example, to selectively couple a local load from a residential or commercial building to a utility power grid. Such devices may also be used to selectively couple a local load to a generator when a power outage has occurred. A typical ATS has two power source inputs and an output. A typical ATS is composed of multiple parts such as an actuator, solenoids and contactor cartridges. ATS designs have complicated constructions and numerous parts, particularly with respect to the actuator and solenoid subsystems.

SUMMARY

Various embodiments provide for apparatuses and systems for automated transfer switches, as well as methods for automated transfer switching. In one embodiment, an automatic transfer switch system includes a plurality of movable contact members including at least one first movable contact member at a first location and at least one second movable contact member at a second location. The automatic transfer switch system further includes at least one fixed contact member, and a permanent magnet operating mechanism configured to control opening and closing of the plurality of movable contact members relative to the at least one fixed contact member via one or more linkages, and to generate a holding force so as to maintain a state of the at least one first movable contact member at the first location and a state of the at least one second movable contact member at the second location.

Another embodiment relates to a transmission subsystem having an automatic transfer switch comprising a pair of movable contact members including a first movable contact member at a first location and a second movable contact member at a second location. The automatic transfer switch further includes a fixed member; a controller configured to select one of the first and second movable contact members; and a permanent magnetic actuator comprising an actuator body, a first driving rod, and a second driving rod. The permanent magnet actuator is configured to move the first driving rod in a first direction independently of movement of the second driving rod. The first driving rod is configured to move the first movable contact member, and the second driving rod is configured to move the second movable contact member.

An additional embodiment relates to a method of carrying out automatic transfer switching in a system. The automatic transfer switch includes a plurality of movable contact members including a first set of movable contact members fixed on and rotatable with a first shaft, and a second set of movable contact members fixed on and rotatable with a second shaft. The switch further includes at least one fixed member; and first and second driving rods respectively fixed with the first and second shafts. The method comprises controlling opening and closing of the plurality of movable contact members relative to the at least one fixed member, and generating a magnetic holding force with one or more permanent magnet actuators so as to maintain a state of the first set of movable contact members and a state of the second set of movable contact members. The first shaft and second shaft are configured such that the first shaft opens before the second shaft closes, and the second shaft opens before the first shaft closes.

Various embodiments of the systems, apparatuses and methods described herein may result in improved reliability and an extended lifetime by achieving a more robust design. Additionally, in various embodiments, the overall complexity and precision required in manufacturing may be reduced. Assembly time may also be reduced.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

DETAILED DESCRIPTION

Figure 1:
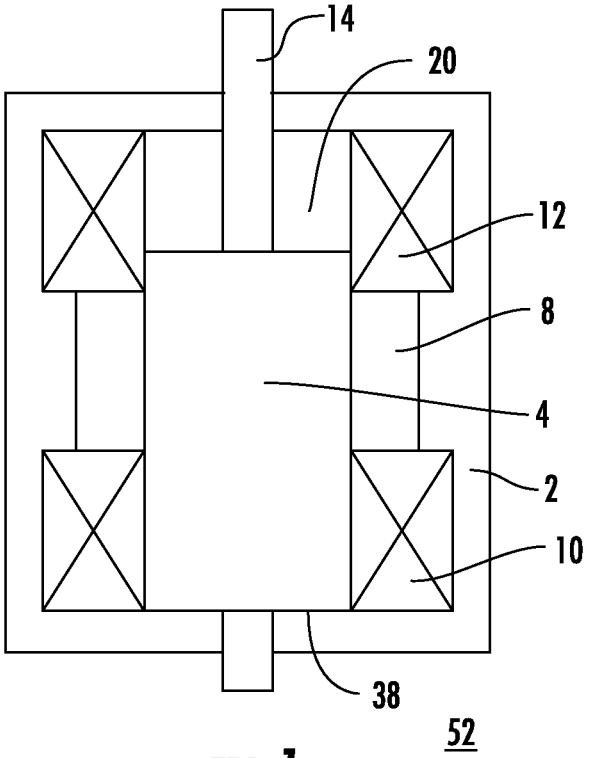
FIG. 1 illustrates a first permanent magnetic actuator according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

As noted above, ATS devices typically are made of complex structures that may have less robust designs and which necessitate obtaining and integrating numerous parts. Accordingly, more robust and simplified switches may alleviate the manufacturing and reliability challenges associated with these devices.

Some ATS devices may include permanent magnetic actuators. ATS devices with such actuators are described in PCT Patent Application Nos. PCT/CN2014/071857, entitled "Automatic Transfer Switch" and filed on Jan. 30, 2014, and PCT/CN2014/079590 entitled "Automatic Transfer Switch," filed on Jun. 10, 2014, which are herein incorporated by reference in their entirety for the technical and background information described therein.

Referring to the figures generally, the various embodiments disclosed herein relate to an automatic transfer switch ("ATS") having a permanent magnetic actuator. In some embodiments, the permanent magnetic actuator operates transmission components to open or close movable contact subsystems (also referred to as contact members) onto fixed contact subsystems. A switch is used to select a first movable contact subsystem ("source A") or a second movable contact subsystem ("source B"). The operation of the transmission components by the permanent magnetic actuator moves the selected movable contact subsystem into an open or closed position. The movable contact subsystems are held in place using the force generated from the permanent magnetic actuator without relying on traditional mechanical locking and tripping devices or solenoids.

FIG. 1 depicts a permanent magnetic operating mechanism with an actuator 52 as may be used in at least one embodiment. The actuating mechanism 52 of FIG. 1 is of a bistable type, in which an opening coil is used to carry out an electromagnetic operation. The bistable permanent magnetic actuator 52 includes, among other things, a driving rod 14, a static iron core 2, a moving iron core 4, a permanent magnet 8, an opening coil 10, and a closing coil 12. As FIG. 1 additionally illustrates, the permanent magnetic actuator 52 further includes a first space 20 and a second space 38. The bistable permanent magnetic actuator 52 uses the closing coil 12 to push the moving iron core 4 to a close site from an open site, and uses the opening coil 10 to push the moving iron core 4 to the open site from the close site.

Figure 2:
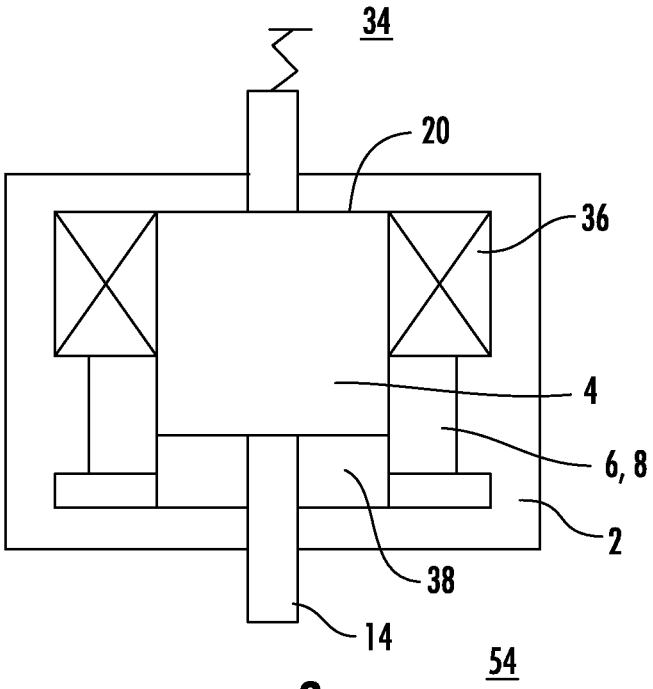
FIG. 2 illustrates a second permanent magnetic actuator according to an embodiment.

FIG. 2 depicts a permanent magnetic actuator as may be used in at least one embodiment. The permanent magnetic actuator of FIG. 2 is a monostable permanent magnetic actuator 54 including similar components to those of FIG. 1. The actuator 54 of FIG. 2 employs a consolidated coil 36 which carries out opening and closing operations. When in a closing operation, the coil 36 is energized to provide power. When in an opening operation, the coil 36 is energized by a current in an opposite direction to that of the closing operation to provide power. A spring 34 is included to facilitate the opening operation to be carried out.

Figure 3:
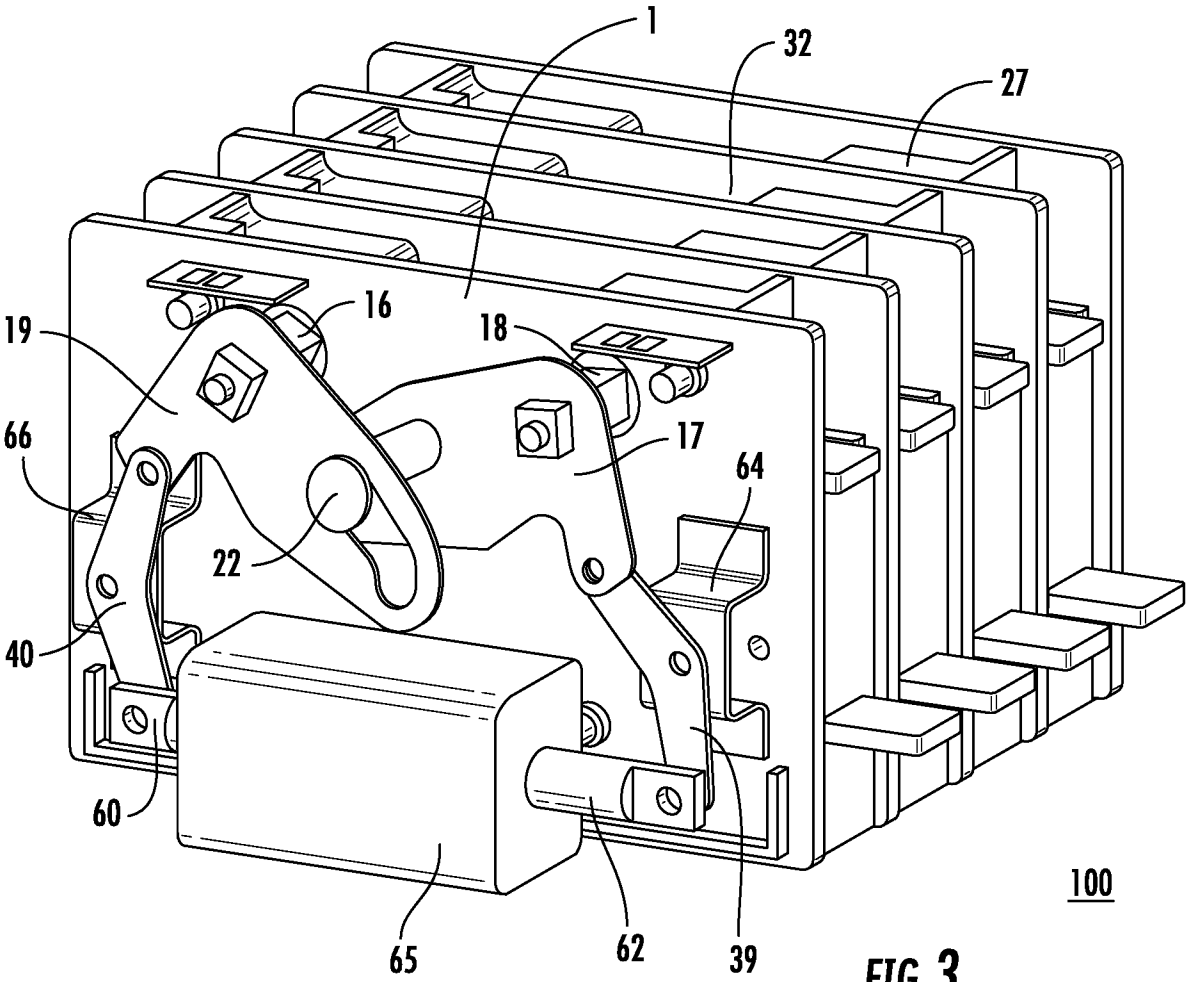
FIG. 3 illustrates a perspective view of an assembly with an automatic transfer switch according to an embodiment.

FIG. 3 depicts a perspective view of an automatic transfer switch according to an embodiment. An automatic transfer switch 100 is depicted, which includes at least one two-pole contact system 27 that is coupled to a baseplate 1 on either the left or right side of the baseplate 1. Rotating square shafts 16, 18 are connected to the baseplate 1 through holes. A first rotating square shaft 16 is coupled to and rotates with a first oscillating rod 19, and a second rotating square shaft 18 is coupled to and rotates with a second oscillating rod 17. A slot may be formed in each of the first and second oscillating rods 17, 19. A pin 22 covered by a sleeve passes through slots in the rods 17, 19. The pin 22 contacts the first and second oscillating rods 17, 19, each of which rotates separately.

In the embodiment shown in FIG. 3, an A source shaft arm 40 and a B source shaft arm 39 are driven directly by a twin output shaft actuator having shafts 60, 62. The shafts 60, 62 may be arranged with one on each side in an independent left-side or right-side arrangement. The actuator may be an actuator such as the permanent magnetic devices shown in FIGS. 1-2 and may be connected to the baseplate 1. For example, the aforementioned twin output shaft actuator may be configured to move the arms 39, 40 which respectively align in an axial direction with a first bracket 64 and a second bracket 66 attached to the baseplate 1.

Referring again to FIG. 3, the automatic transfer switch 100 is arranged such that the pin 22 passes through the baseplate 1 and the slots of the first and second oscillating rods 17, 19. The pin 22 pushes the first and second oscillating rods 17, 19, each of which rotate separately, as noted above. Rotating square shafts 16 and 18 are fixed to the first and second oscillating rods 17, 19, respectively, and rotate with the respective oscillating rod. By virtue of providing the permanent magnetic actuator with two different shafts 60, 62 at two ends, the actuator may work in two different direction independently to drive the two source moving contacts (Source A and Source B) separately.

Figure 4:
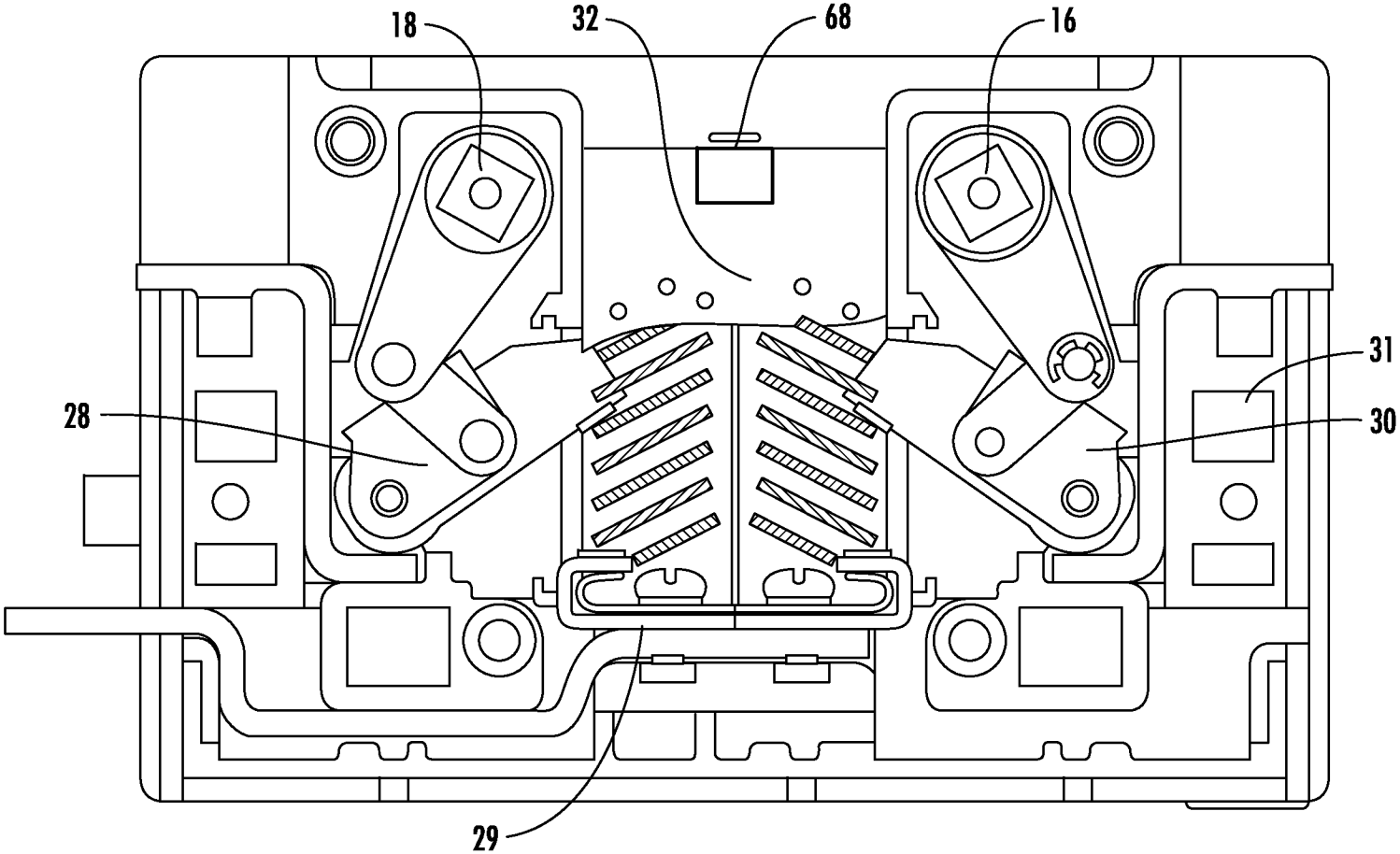
FIG. 4 illustrates a sectional side view of a transmission subsystem with a two-pole contact system and an automatic transfer switch according to an embodiment.

As shown in FIGS. 3-4, the ATS 100 includes a plurality of movable contact members 28, 30. The actuator having shafts 60, 62 is configured to control opening and closing of the plurality of movable contact members relative to at least one fixed contact member via one or more oscillating rods 17, 19, and to generate a holding force so as to maintain a state of at least one first movable contact member at a first location and a state of the at least one second movable contact member at a second location. Each of the shafts 60, 62 (also referred to as driving rods) is configured to transmit a driving force from the body of the actuator. The ATS 100 is configured so as to move the first shaft 60 in a first direction independently of movement of the second shaft 62. The ATS 100 is further configured to move the second shaft 62 in a second direction independently of movement of the first shaft 60 in the first direction. Shafts 60, 62 do not both move at the same time.

As indicated in FIGS. 3-4, in certain embodiments, an automatic transfer switch such as the ATS 100 can be configured to one of three states. The states include a neutral position, occurring when the permanent magnet actuator 65 has drawn the pin 22 to a given position relative to the baseplate 1, and in which both a source A movable contact subsystem 30 and a source B movable contact subsystem 28 are in an open position (i.e., not in contact with a fixed contact subsystem). Permanent magnetic actuator 65 can be configured by actuator 52 or actuator 54.

Returning again to FIGS. 3-4, the two-pole contact system includes a fixed contact subsystem 29 and a chute system 32 which are assembled between the source A and source B movable contact subsystems 30, 28. The source A movable contact subsystem 30 is fixed to the rotating square shaft 16. The source A movable contact subsystem 30 rotates with the rotating square shaft 16 and couples the fixed contact subsystem 29 to a source A input. The source B movable contact subsystem 28 is fixed to the rotating square shaft 18. The source B movable contact subsystem 28 rotates with the rotating square shaft 18 and couples the fixed contact subsystem 29 to a source B input. Shaft 60 is configured to be in an open position when the contact subsystem 30 is in an open position, and the second shaft 62 is configured to be in an open position when the contact subsystem 28 is in an open position. In some embodiments, the contact subsystems 28-30 are provided in a cassette subsystem.

Further, various embodiments include a control module 68 as shown in FIG. 4 which includes control circuitry permitting selection of the movable contact subsystems 28, 30. For example, the control module 68 may select one of the source A movable contact subsystem 30 and the source B movable contact subsystem 28 to facilitate a switching operation. The control module 68 may include programmable control logic and at least one printed circuit board (PCB). Further, the control module 68 may include a non-transitory computer-readable memory having instructions thereon to facilitate the control of movable contact members. Although the movement of the movable contact subsystems 28, 30 may be controlled in such a fashion, the movable contact subsystems 28, 30 are also configured to be moved manually.

Referring again to FIG. 4, a sectional side view of a two-pole contact system of an automatic transfer switch is shown, with the first and second movable contact subsystems in a neutral position and the fixed contact subsystem 29 not coupled to either the source A movable contact subsystem 30 or the source B movable contact subsystem 28.

The movable contact subsystems 28, 30 are in an open neutral position and held in place by the permanent magnetic actuator 65. The first and second oscillating rods 17, 19 both stay in a position corresponding to an angle that the rotating square shafts 16, 18 are rotated to, thereby placing the movable contact subsystems 28, 30 in a neutral position at a distance from the fixed contact subsystem 29. The distance can be, for example, a distance corresponding to a maximum angle from the fixed contact subsystem 29.

In some embodiments, the actuator has a first state in which the permanent magnet operating mechanism is configured to retain the actuator unless a coil is powered to retain the actuator in a second state. In at least one embodiment, the actuator has a first magnetically stable retained state and second magnetically stable retained state, and the actuator is configured to transition between the first and the second states when at least one coil of the actuator receives power. The actuator of certain embodiments is connected at first and second ends of the actuator, and is configured to move the automatic transfer switch between a first state, a second state, and a third state. In at least one embodiment, the first state corresponds to a first source, the second state corresponds to a neutral, and the third state corresponds to a second source. Further, the actuator of certain embodiments may be a dual-end, dual-slug actuator or a single-slug piston actuator.

It is noted that the permanent magnetic actuator of various embodiments may be either bistable, with permanent magnetic holding states at each first and second end of the throw of each actuator. Alternatively, the actuators may be monostable, with only one coil receiving power to keep permanent magnetic holding states at each first and second end of the throw of each actuator. Further, in some instances, at least one bistable actuator may be provided, while in other instances, at least one monostable actuator may be provided.

Figure 5:
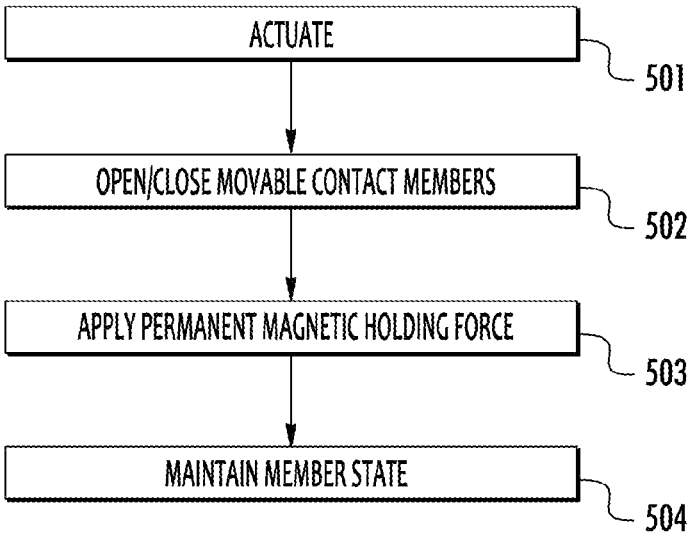
FIG. 5 illustrates a process for automatic transfer switching according to an embodiment.

Turning now to FIG. 5, a method of carrying out automatic transfer switching according to an embodiment is shown. Specifically, a method 500 is described for carrying out automatic transfer switching is shown for an automatic transfer switch which includes a plurality of movable contact members including a first set of movable contact members fixed on and rotatable with a first shaft, and a second set of movable contact members fixed on and rotatable with a second shaft. The switch further includes at least one fixed member, and first and second driving rods respectively fixed with the first and second shafts. The method 500 includes actuating the switch via an actuator such as those described above in FIGS. 1-4 (501). The method further includes controlling opening and closing of the plurality of movable contact members relative to the at least one fixed member (502). Additionally, the method includes applying a magnetic holding force with one or more permanent magnet actuators (503). Upon applying suitable force, the method further includes maintaining a state of the first set of movable contact members and a state of the second set of movable contact members (504).

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

The terms "coupled," "connected," and the like as used herein mean the joining of two members directly or indirectly to one another. Such joining may be stationary (e.g., permanent) or movable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "right," "left," etc.) are merely used to describe the orientation of various elements in the drawings. It should be noted that the orientation of various elements may differ according to other example embodiments, and that such variations are intended to be encompassed by the present disclosure.

The construction and arrangement of the aforementioned various example embodiments are illustrative only. Although only a few embodiments are described in detail in this disclosure, those skilled in the art will readily appreciate that, unless specifically noted, many modifications are possible (e.g., variations in sizes, structures, shapes and proportions of the various elements, values of parameters, mounting arrangements, use of materials, orientations, etc.) without materially departing from the teachings and advantages of the subject matter described herein. For example, elements shown as integrally formed may be constructed of multiple parts or elements, the position of elements may be reversed or otherwise varied, and the nature or number of discrete elements or positions may be altered or varied. Unless specifically noted, the order or sequence of any process or method steps may be varied or re-sequenced according to alternative embodiments.

The foregoing description of illustrative embodiments is not intended to be exhaustive or limiting with respect to the precise form disclosed, and modifications and variations, such as those discussed above, are possible in light of the above teachings or may be acquired from practice of the disclosed embodiments. Other substitutions, modifications, changes and omissions may also be made in the design, operating conditions and arrangement of the various example embodiments without departing from the scope of the present invention.

The invention claimed is:

1. An automatic transfer switch, comprising:

a plurality of movable contact members including at least one first movable contact member at a first location and at least one second movable contact member at a second location;

at least one fixed contact member; and a permanent magnet operating mechanism configured to:

control opening and closing of the plurality of movable contact members relative to the at least one fixed contact member via one or more linkages; and generate a holding force so as to maintain a state of the at least one first movable contact member at the first location and a state of the at least one second movable contact member at the second location, wherein the permanent magnet operating mechanism comprises an actuator having an actuator body, a first driving rod, and a second driving rod.

2. The automatic transfer switch of claim 1, wherein:

each of the first driving rod and the second driving rod is configured to transmit a driving force from the actuator body;

the permanent magnet operating mechanism is configured to move the first driving rod in a first direction independently of movement of the second driving rod; and the permanent magnet operating mechanism is configured to move the second driving rod in a second direction independently of movement of the first driving rod in the first direction.

3. The automatic transfer switch of claim 1, wherein the first driving rod is configured to move the at least one first movable contact member at the first location, and wherein the second driving rod is configured to move the at least one second movable contact member at the second location.

4. The automatic transfer switch of claim 1, wherein:

the one or more linkages comprises a first shaft and a second shaft rotatably supported and coupled to the first and second movable contact members, respectively, and the first and second shafts are driven respectively via the first driving rod and the second driving rod by the permanent magnet operating mechanism.

5. The automatic transfer switch of claim 4, wherein:

the first shaft and the second shaft are configured to rotate in accordance with the opening and closing of the plurality of movable contact members, the first shaft is configured to be in an open position when the first movable contact member is in an open position, and the second shaft is configured to be in an open position when the second movable contact member is in an open position.

6. The automatic transfer switch of claim 1, further comprising a cassette subsystem, wherein the cassette subsystem comprises the plurality of movable contact members and the at least one fixed contact member.

7. The automatic transfer switch of claim 1, wherein the plurality of movable contact members are configured to be moved manually.

8. The automatic transfer switch of claim 1, wherein the permanent magnet operating mechanism is configured to permit closing of at least one movable contact member onto at least one fixed contact member and opening of at least one movable contact member from at least one fixed contact member.

9. The automatic transfer switch of claim 1, wherein the actuator has a first state in which the permanent magnet operating mechanism is configured to retain the actuator unless a coil is powered to retain the actuator in a second state.

10. The automatic transfer switch of claim 1, wherein the actuator has a first state and a second state, and the actuator is configured to transition between the first and the second states when at least one coil of the actuator receives power.

11. The automatic transfer switch of claim 10, wherein the actuator is a dual-end, dual-slug actuator.

12. The automatic transfer switch of claim 1, wherein the actuator is configured to move the automatic transfer switch between a first state, a second state, and a third state.

13. The automatic transfer switch of claim 12, wherein the first state corresponds to a first source, the second state corresponds to a neutral, and the third state corresponds to a second source.

14. The automatic transfer switch of claim 12, wherein the actuator is a single-slug piston actuator.

15. A transmission subsystem having an open transition automatic transfer switch, comprising:

a pair of movable contact members including a first movable contact member at a first location and a second movable contact member at a second location;

a fixed contact member;

a controller configured to select one of the first and second movable contact members; and a permanent magnetic actuator comprising an actuator body, a first driving rod, and a second driving rod, the permanent magnet actuator being configured to move the first driving rod in a first direction independently of movement of the second driving rod;

wherein the first driving rod is configured to move the first movable contact member, and the second driving rod is configured to move the second movable contact member.

16. The transmission subsystem of claim 15, wherein the permanent magnetic actuator comprises at least one bistable permanent actuator.

17. The transmission subsystem of claim 15, wherein the permanent magnetic actuator comprises at least one monostable permanent actuator.

18. The transmission subsystem of claim 15, wherein the controller comprises control circuitry.

19. The transmission subsystem of claim 15, wherein a cassette comprises the pair of movable contact members and the fixed contact member.

20. The transmission subsystem of claim 15, wherein the pair of movable contact members are configured to be moved manually.

21. A method of actuating an automatic transfer switch in a system, the automatic transfer switch including a plurality of movable contact members including a first set of movable contact members fixed on and rotatable with a first shaft, and a second set of movable contact members fixed on and rotatable with a second shaft; at least one fixed contact member; and first and second driving rods respectively fixed with the first and second shafts, the method comprising:

controlling opening and closing of the plurality of movable contact members relative to the at least one fixed contact member; and generating a magnetic holding force with one or more permanent magnet actuators so as to maintain a state of the first set of movable contact members and a state of the second set of movable contact members, wherein the first shaft is configured to be in an open position when the first movable contact member is in an open position, and the second shaft is configured to be in an open position when the second movable contact member is in an open position.

22. The method of claim 21, further comprising:

selecting one of the first and second sets of movable contact members to be opened and closed relative to the at least one fixed contact member.

* * * * *